US010471568B2

(12) United States Patent
Sugiura et al.

(10) Patent No.: US 10,471,568 B2
(45) Date of Patent: Nov. 12, 2019

(54) SHOT PROCESS DEVICE

(71) Applicant: SINTOKOGIO, LTD., Nagoya-shi, Aichi (JP)

(72) Inventors: Takeshi Sugiura, Aichi (JP); Tadanobu Oyama, Aichi (JP)

(73) Assignee: SINTOKOGIO, LTD., Nagoya-shi, Aichi (JP)

( * ) Notice: Subject to any disclaimer, the term of this patent is extended or adjusted under 35 U.S.C. 154(b) by 524 days.

(21) Appl. No.: 15/124,124

(22) PCT Filed: Aug. 29, 2014

(86) PCT No.: PCT/JP2014/072817

§ 371 (c)(1),
(2) Date: Sep. 7, 2016

(87) PCT Pub. No.: WO2015/136737

PCT Pub. Date: Sep. 17, 2015

(65) Prior Publication Data

US 2017/0209982 A1 Jul. 27, 2017

(30) Foreign Application Priority Data

Mar. 10, 2014 (JP) ..... 2014-046642

(51) Int. Cl.
*B24C 1/10* (2006.01)
*B24C 3/24* (2006.01)
*B24C 3/20* (2006.01)

(52) U.S. Cl.
CPC ..... *B24C 1/10* (2013.01); *B24C 3/20* (2013.01); *B24C 3/24* (2013.01)

(58) Field of Classification Search
CPC .. B21D 31/06; B24C 1/10; B24C 3/20; B24C 3/22; B24C 3/24; C21D 7/06
See application file for complete search history.

(56) References Cited

U.S. PATENT DOCUMENTS 5,029,419 A * 7/1991 Nakayama ..... B24C 1/083 451/38
5,272,897 A 12/1993 Wern
2016/0214223 A1* 7/2016 Wern ..... B23Q 3/069

FOREIGN PATENT DOCUMENTS

CN 101301731 11/2008
CN 202240940 U 5/2012
(Continued)

OTHER PUBLICATIONS

English-language translation of International Preliminary Report on Patentability (IPRP) dated Sep. 22, 2016 that issued in WO Patent Application No. PCT/JP2014/072817.

*Primary Examiner* — Debra M Sullivan
(74) *Attorney, Agent, or Firm* — Drinker Biddle & Reath LLP

(57) ABSTRACT

A shot processing apparatus according to an aspect includes: a projector; a set table configured to support the workpiece from below and be rotatable about an axis; a retaining mechanism including a retainer opposed to the set table with the workpiece interposed, the retainer being configured to be rotatable about the axis and movable in a direction of the axis; a rotational force driver configured to apply rotational force to the retainer through a transmission mechanism; and a lifting mechanism including a pressing holder capable of being lifted and lowered above the retaining mechanism, the lifting mechanism being at a distance from the retaining mechanism when the pressing holder is located above a reference height, the lifting mechanism applying pressing force to the workpiece through the retainer when the pressing holder is located below the reference height.

10 Claims, 14 Drawing Sheets

(56) References Cited

FOREIGN PATENT DOCUMENTS

| | | | |
|---|---|---|---|
| CN | 102793369 | | 11/2012 |
| CN | 103201073 | | 7/2013 |
| DE | 4408643 | C1 | 6/1995 |
| JP | H1-271175 | | 10/1989 |
| JP | H04-57673 | A | 2/1992 |
| JP | 2003-117830 | A | 4/2003 |
| WO | WO 2004/048039 | | 6/2004 |
| WO | WO-2009/133989 | A1 | 11/2009 |
| WO | WO-2013/121632 | A1 | 8/2013 |

* cited by examiner

SHOT PROCESS DEVICE

TECHNICAL FIELD

The present invention relates to a shot processing apparatus.

BACKGROUND ART

In an example of shot processing apparatuses, a workpiece (a subject to be processed, work) is set on a set table, and shot is projected to the workpiece while the workpiece is rotated with pressing force (compressive force) being applied to the workpiece. For example, Patent Literature 1 below discloses a configuration in which a retaining mechanism for retaining a workpiece from above, a lifting mechanism for applying pressing force to the workpiece, and a rotating mechanism for rotating the workpiece are integrated.

CITATION LIST

Patent Literature

[Patent Literature 1] Chinese Examined Utility Model Publication No. 202240940

SUMMARY OF INVENTION

Technical Problem

Unfortunately, when the lifting mechanism and the rotating mechanism disclosed in Patent Literature 1 above are applied to, for example, a multi-table type (in which a plurality of set tables are disposed on a rotating table and the set tables are transported to a loading chamber, a projection chamber, and an unloading chamber) shot processing apparatus, it is necessary to install a retaining mechanism, a lifting mechanism, and a rotating mechanism individually for each of the set tables located in the loading chamber and the unloading chamber. For this reason, the structure in Patent Literature 1 above is inefficient for such a multi-table type shot processing apparatus and thus less versatile.

In view of the situations above, an object according to aspects of the present invention is to provide a shot processing apparatus having a versatile structure.

Solution to Problem

A shot processing apparatus according to an aspect includes: a projector configured to project shot to a workpiece; a set table configured to support the workpiece from below and be rotatable about an axis extending in a top-bottom direction; a retaining mechanism including a retainer opposed to the set table with the workpiece interposed, the retainer being configured to be rotatable about the axis and movable in a direction of the axis; a rotational force driver configured to apply rotational force to the retainer through a transmission mechanism; and a lifting mechanism including a pressing holder capable of being lifted and lowered above the retaining mechanism, the lifting mechanism being at a distance from the retaining mechanism when the pressing holder is located above a reference height at which the pressing holder is in contact with the retainer, the lifting mechanism being coupled to the retaining mechanism to apply pressing force to the workpiece through the retainer when the pressing holder is located below the reference height.

In the shot processing apparatus according to an aspect, a workpiece is supported on the set table from below. The retainer is disposed above the workpiece to be opposed to the set table with the workpiece interposed. Shot is projected by the projector to the workpiece.

The lifting mechanism separate from the retaining mechanism is provided above the retaining mechanism. When the pressing holder is located above the reference height, the lifting mechanism is at a distance from the retaining mechanism. When the pressing holder is located below the reference height, the lifting mechanism is coupled to the retaining mechanism to apply pressing force to the workpiece through the retainer. The rotational force by the rotational force driver is then transmitted to the retainer through the transmission mechanism. With this configuration, shot can be projected to the workpiece by the projector while the workpiece is rotated with pressing force being applied to the workpiece.

As described above, the retaining mechanism and the lifting mechanism are separated from each other. Therefore, in a multi-table type (in which a plurality of set tables are disposed on a rotating table and the set tables are conveyed to a loading chamber, a projection chamber, and an unloading chamber) shot processing apparatus, for example, the lifting mechanism may be provided for the set table disposed in the projection chamber, so that the lifting mechanism is not required for the set tables disposed in the loading chamber and the unloading chamber. For example, the lifting mechanism may be provided for the set table disposed in the loading chamber to restrict the upward movement of the retainer, so that the lifting mechanism is not required for the set table disposed in the projection chamber. In a single table-type (in which the projection chamber doubles as a loading/unloading chamber) shot processing apparatus, the lifting mechanism may be provided for a set table, so that shot is projected to the workpiece by the projector while the workpiece is rotated with pressing force being applied to the workpiece. With the configuration as described above, a versatile structure can be implemented in a shot processing apparatus.

In an embodiment, the rotational force driver may be provided to the lifting mechanism.

In the shot processing apparatus according to the embodiment above, since the rotational force driver is provided to the lifting mechanism, the rotational force driver and the lifting mechanism may be combined in one unit.

In an embodiment, the shot processing apparatus may further include a lock mechanism configured to prevent upward movement of the retainer in a state in which the retainer applies pressing force to the workpiece.

In the shot processing apparatus according to the embodiment above, in a state in which the retainer presses the workpiece, the lock mechanism prevents upward movement of the retainer to maintain the pressing on the workpiece by the retainer.

In an embodiment, a load receiving member may be rotatably supported on an upper end of the retainer. An abutment part may be provided to a lower end of the retainer to come into abutment with the workpiece. The lifting mechanism may apply pressing force to the load receiving member when the pressing holder is located below the reference height.

In the shot processing apparatus according to the embodiment above, the load receiving member is rotatably supported on the upper end of the retainer. When the pressing holder of the lifting mechanism is located below the reference height, the load receiving member is pressed downward by the lifting mechanism. This configuration enables rotation of the retainer while applying downward pressing force to the retainer.

In an embodiment, the transmission mechanism may include a sprocket and a chain.

In the shot processing apparatus according to the embodiment above, the transmission mechanism including a sprocket and a chain transmits rotational force from the rotational force driver to the retaining mechanism. With this configuration, for example, the rotational force from the rotational force driver can be transmitted to a plurality of retainers.

In an embodiment, the transmission mechanism may include a plurality of gears.

In the shot processing apparatus according to the embodiment above, the rotation transmission including the gears transmits the rotational force from the rotational force driver to the retaining mechanism. With this configuration, for example, the rotational force from the rotational force driver can be transmitted to a plurality of retainers.

In an embodiment, the set table may be coupled with a set table driving mechanism actuated to rotate the set table. The set table driving mechanism may be set to be actuated prior to the rotational force driver.

In the shot processing apparatus according to the embodiment above, when the set table and the retainer are rotated with the workpiece held between them, the set table rotates prior to the retainer, so that relative rotation between the workpiece and the set table is prevented or minimized. This configuration prevents or minimizes damage and the like at the contact portion of the workpiece with the set table.

In an embodiment, the shot processing apparatus may further include a rotating table configured to be rotatable about a center axis extending in the top-bottom direction. A region above the rotating table may be divided into a projection region in which the shot from the projector is projected and a non-projection region excluding the projection region. On the rotating table, a plurality of the set tables and a plurality of the retaining mechanisms may be disposed in a peripheral direction of the rotating table. The rotating table may rotate to allow the workpiece to be conveyed between the projection region and the non-projection region. The lifting mechanism may be provided exclusively above the projection region.

In the shot processing apparatus according to the embodiment above, the shot processing apparatus is configured as a multi-table type shot processing apparatus, and the lifting mechanism is provided corresponding only to the set table located in the projection area. The lifting mechanism thus can be configured efficiently for a multi-table type shot processing apparatus.

In an embodiment, the shot processing apparatus may further include a rotating table configured to be rotatable about a center axis extending in a bottom direction. A region on the rotating table may be divided into a projection region in which the shot from the projector is projected and a non-projection region excluding the projection region. On the rotating table, a plurality of the set tables, a plurality of the retaining mechanisms, and a plurality of the lock mechanisms are disposed in a peripheral direction of the rotating table. The rotating table may rotate to allow the workpiece to be conveyed between the projection region and the non-projection region. The lifting mechanism may be provided exclusively above the non-projection region.

In the shot processing apparatus according to the embodiment above, the shot processing apparatus is configured as a multi-table type shot processing apparatus, and the lifting mechanism is provided corresponding only to the set table disposed in the non-projection region. The lifting mechanism thus can be configured efficiently for a multi-table type shot processing apparatus.

In an embodiment, the shot processing apparatus may further include a mounting and demounting mechanism configured to support mounting and demounting of the workpiece on the set table. The mounting and demounting mechanism may be configured to be engageable with the retaining mechanism and to be lifted and lowered in the top-bottom direction.

In the shot processing apparatus according to the embodiment above, the mounting and demounting mechanism is lifted in a state in which the mounting and demounting mechanism is engaged with the retaining mechanism, whereby the retaining mechanism can be elevated to a distant position. This configuration can facilitate mounting and demounting of the workpiece on the set table.

Advantageous Effects of Invention

As described above, a versatile structure can be implemented in the shot processing apparatus according to the present invention.

Figure 7:
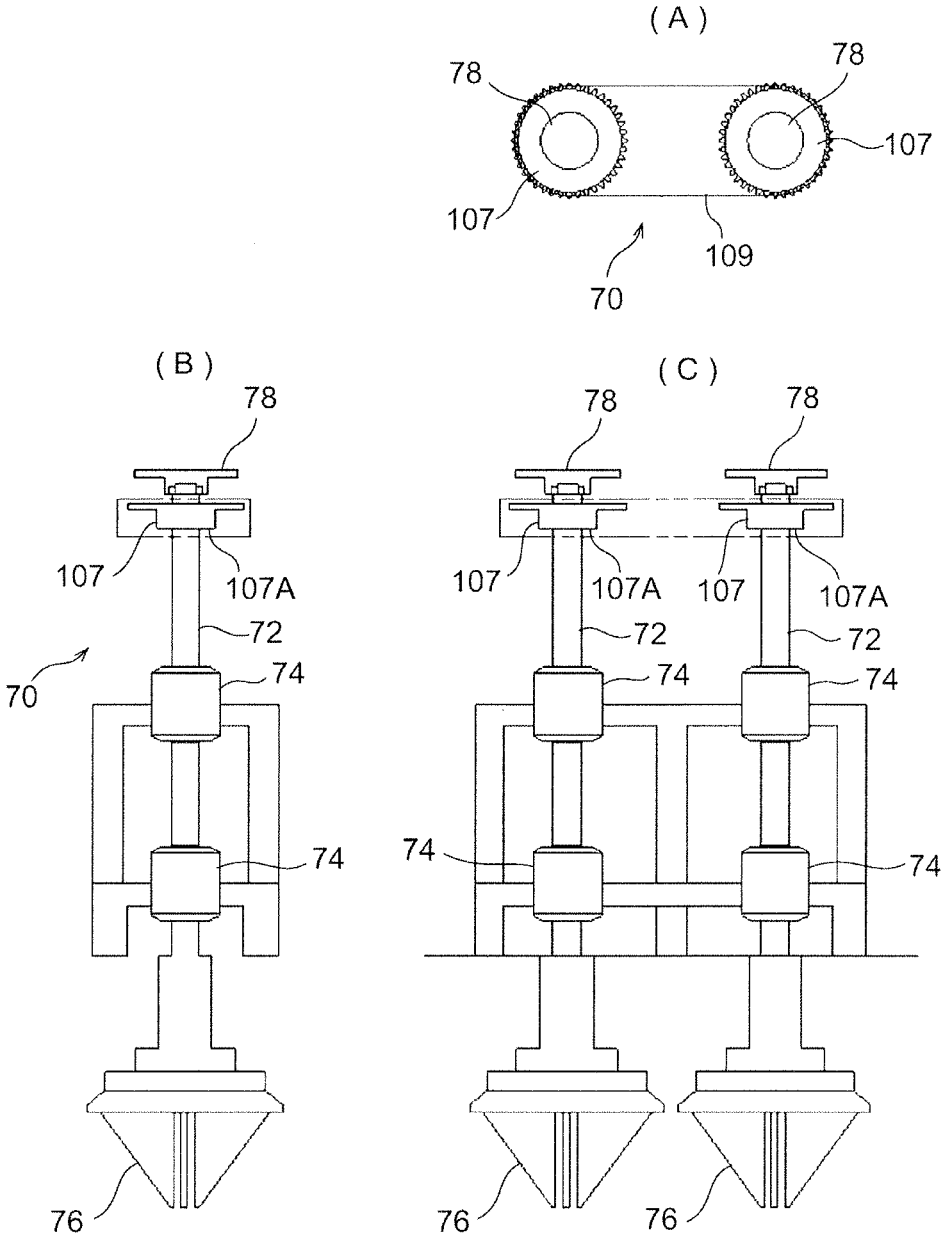

(A) in FIG. 7 is a plan view of a retaining mechanism for use in the shot peening apparatus according to the first embodiment, (B) in FIG. 7 is a side view of the retaining mechanism, and (C) in FIG. 7 is a front view of the retaining mechanism.

Figure 8:
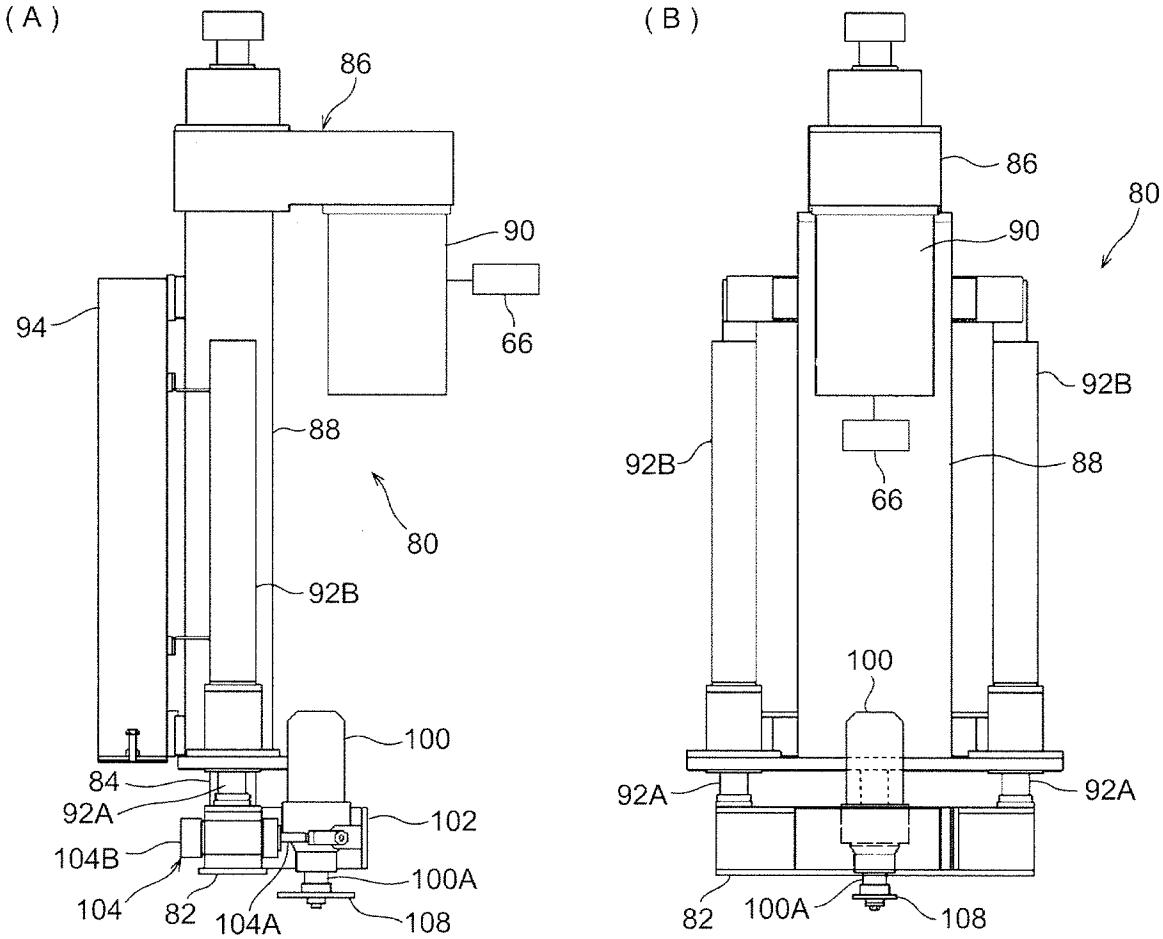

(A) in FIG. 8 is a side view of a lifting mechanism for use in the shot peening apparatus according to the first embodiment, and (B) in FIG. 8 is a front view of the lifting mechanism.

Figure 9:
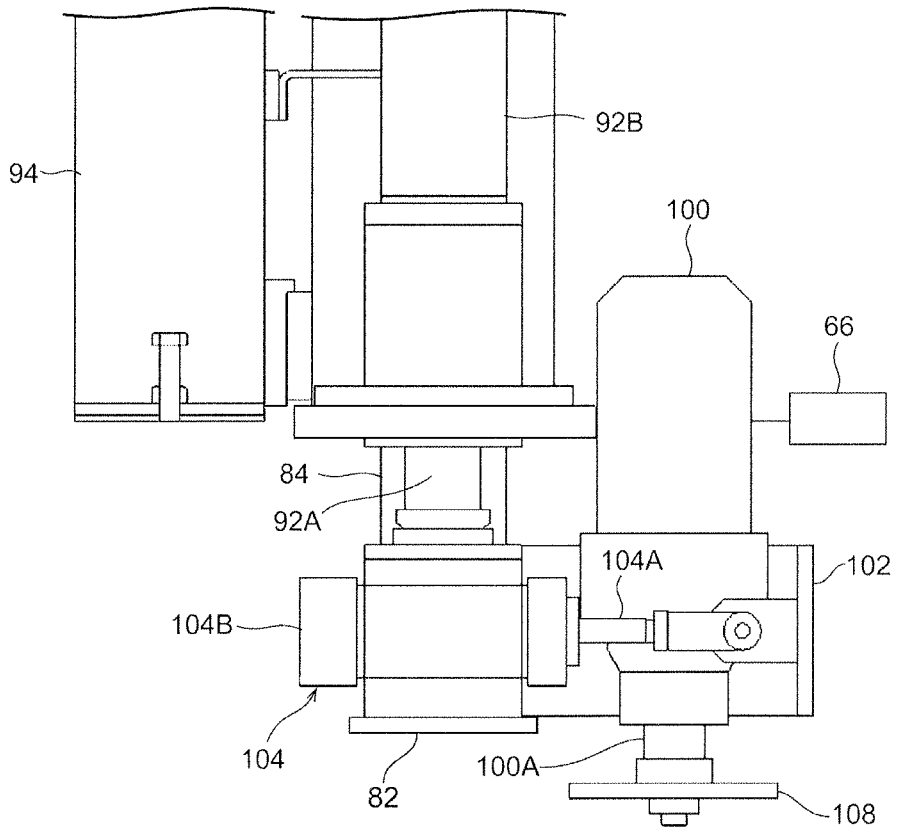

FIG. 9 is a partially enlarged view of the lower end of the lifting mechanism shown in (A) in FIG. 8.

Figure 10:
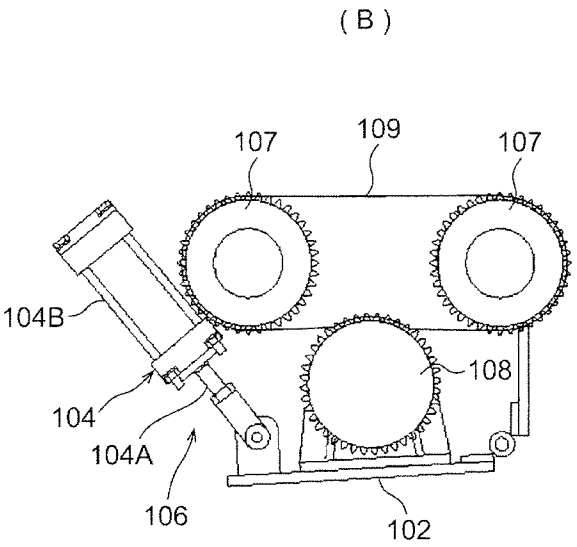
Figure 10:
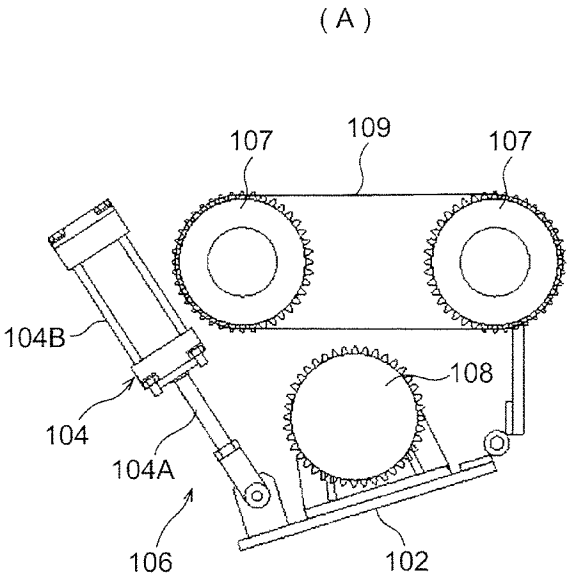

(A) in FIG. 10 is a schematic plan view of a transmission mechanism for use in the shot peening apparatus according to the first embodiment, and (B) in FIG. 10 is a schematic plan view of the actuated state of the transmission mechanism in (A) in FIG. 10.

Figure 11:
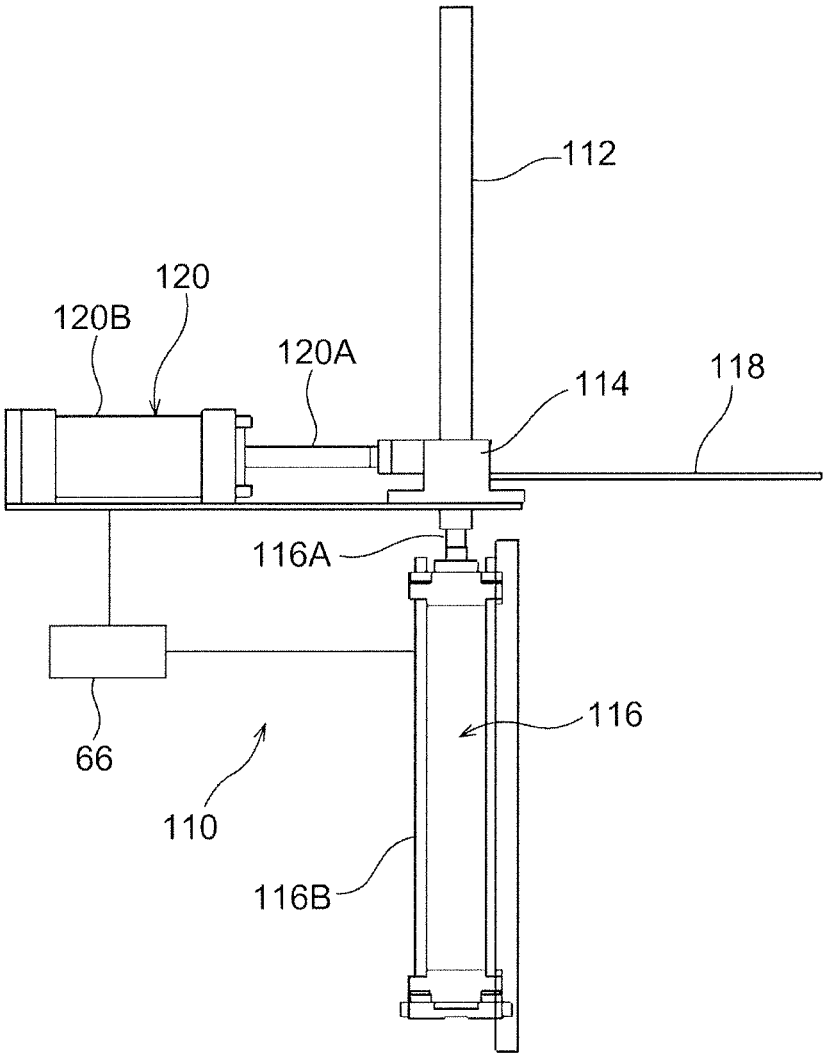

FIG. 11 is a side view of a mounting and demounting mechanism for use in the shot peening apparatus according to the first embodiment.

Figure 12:
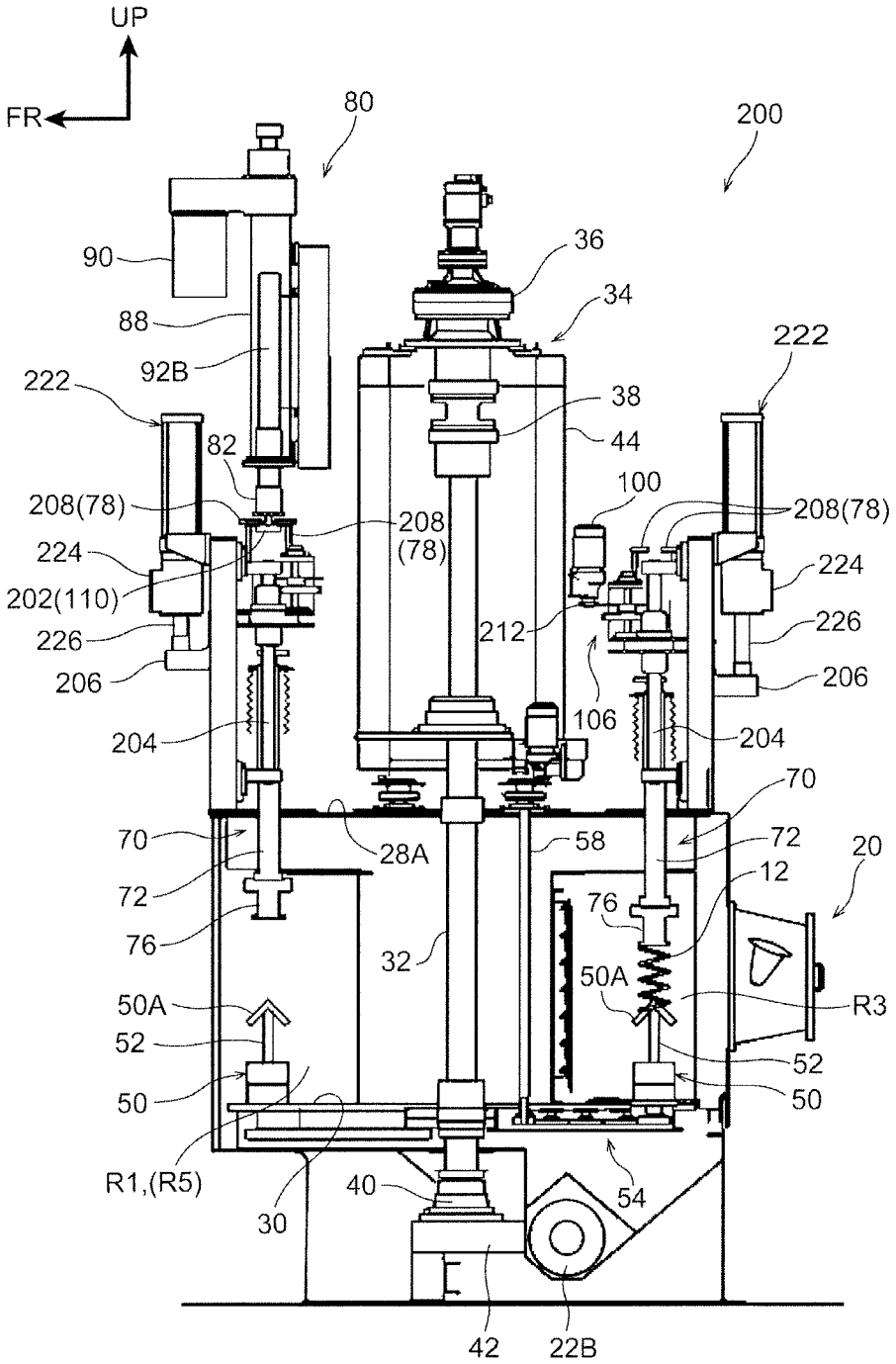

FIG. 12 is a cross-sectional view of the main part of a shot peening apparatus according to a second embodiment shown in a right side view.

Figure 13:
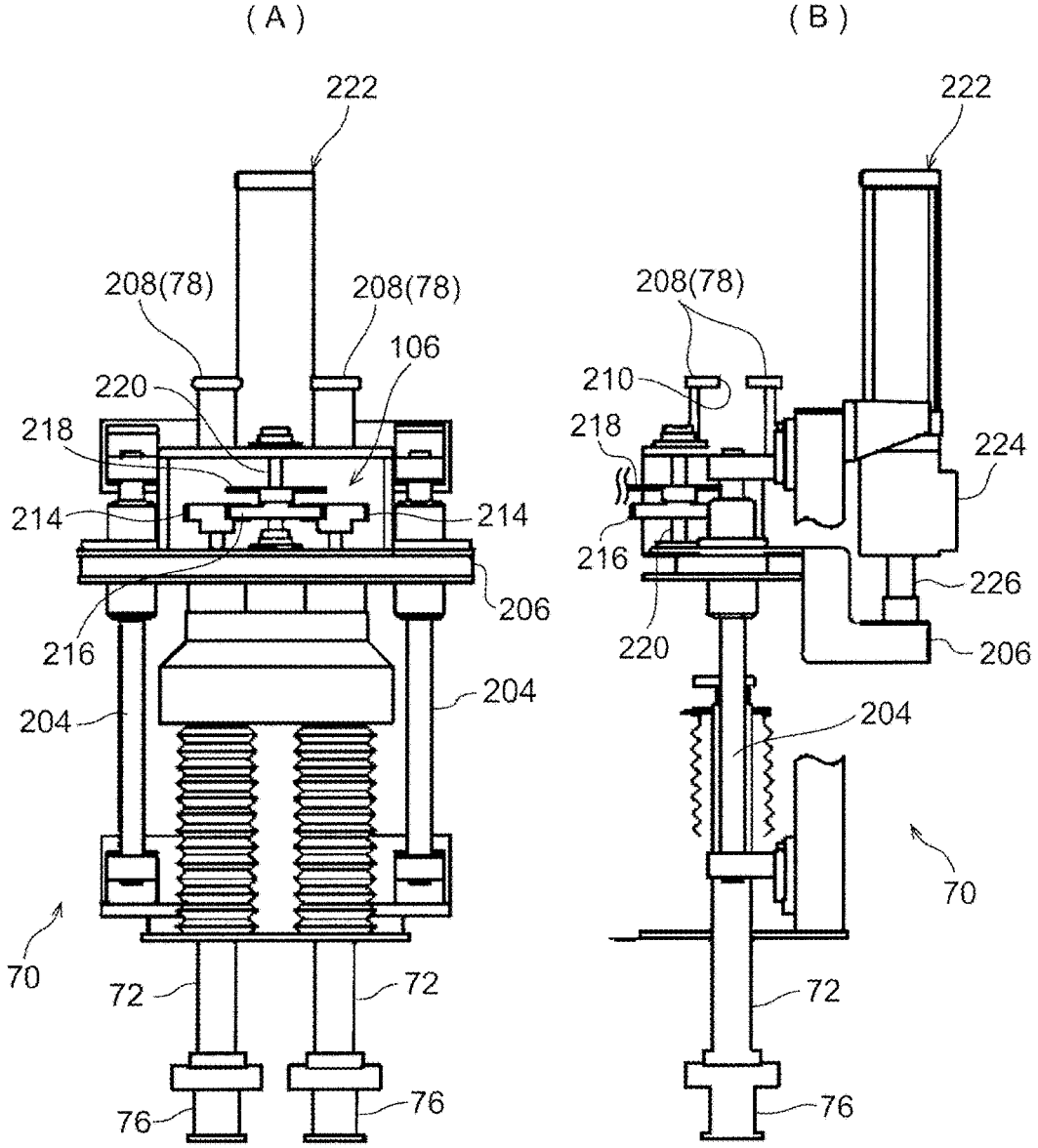

(A) in FIG. 13 is a side view of a retaining mechanism for use in the shot peening apparatus according to the second embodiment, and (B) in FIG. 13 is a rear view of the retaining mechanism.

Figure 14:
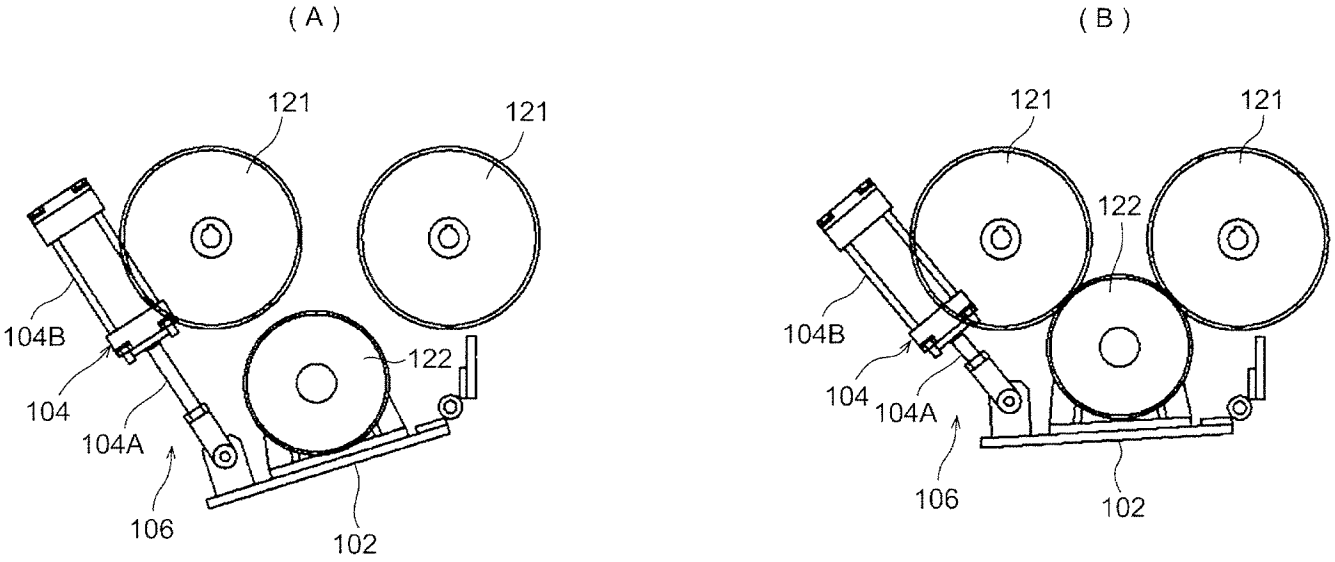

(A) in FIG. 14 is a plan view corresponding to (A) in FIG. 10, schematically illustrating another example of the transmission mechanism shown in FIG. 10, and (B) in FIG. 14 is a plan view corresponding to (B) in FIG. 10, schematically illustrating the actuated state of the transmission mechanism in (A) in FIG. 14.

DESCRIPTION OF EMBODIMENTS (First Embodiment)

Referring to FIG. 1 to FIG. 11, a shot peening apparatus 10, which is a "shot processing apparatus" according to a first embodiment, will be described below. The arrow FR shown as necessary in the figures indicates the front side in the apparatus front view, the arrow UP indicates the upper side of the apparatus, and the arrow LH indicates the left side in the apparatus front view. In the following description, the apparatus top-bottom direction is referred to as the top-bottom direction, and the apparatus right-left direction is referred to as the right-left direction.

Figure 1:
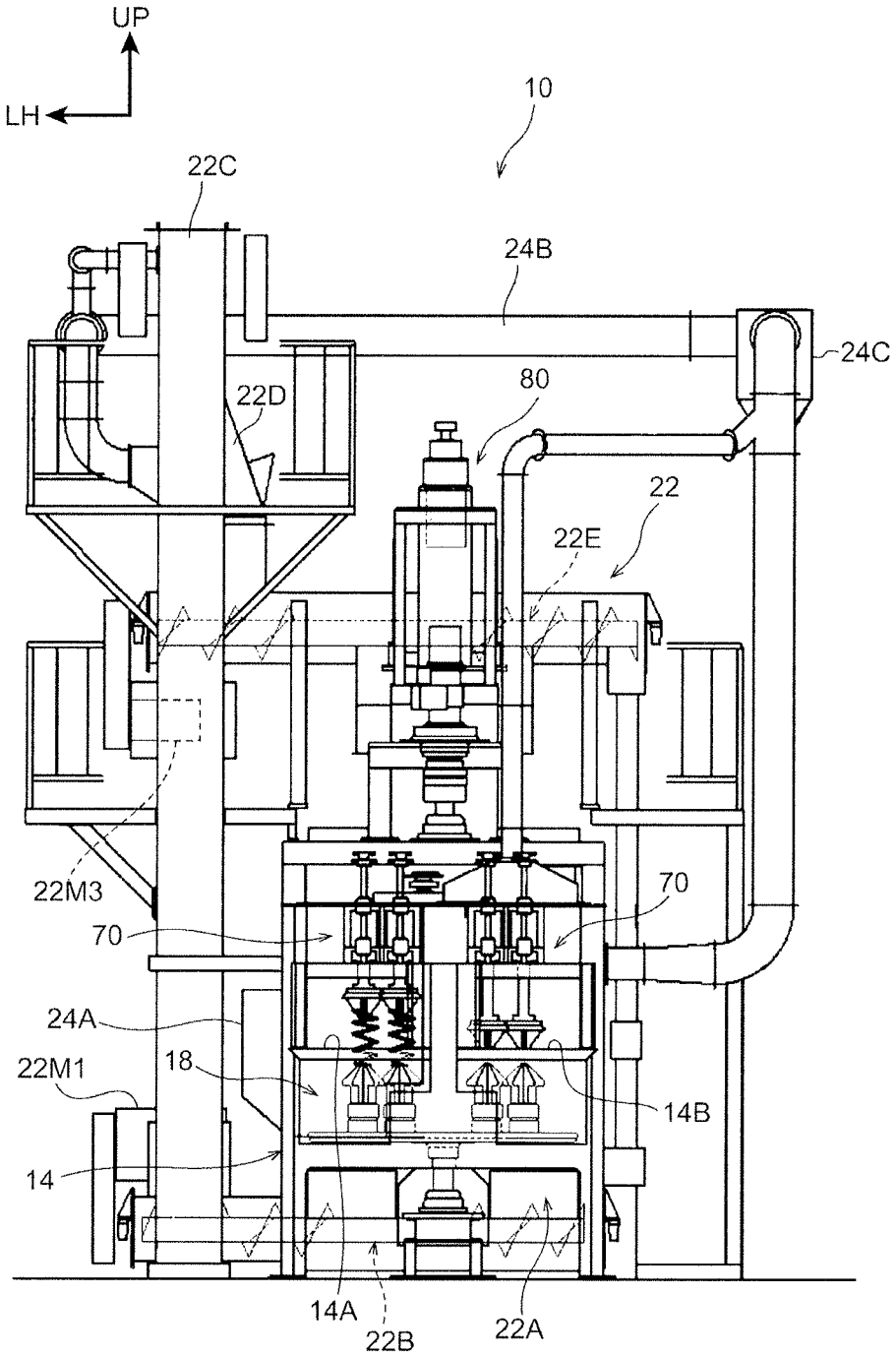
FIG. 1 is a front view of a shot peening apparatus according to a first embodiment shown in a partially perspective view.
Figure 2:
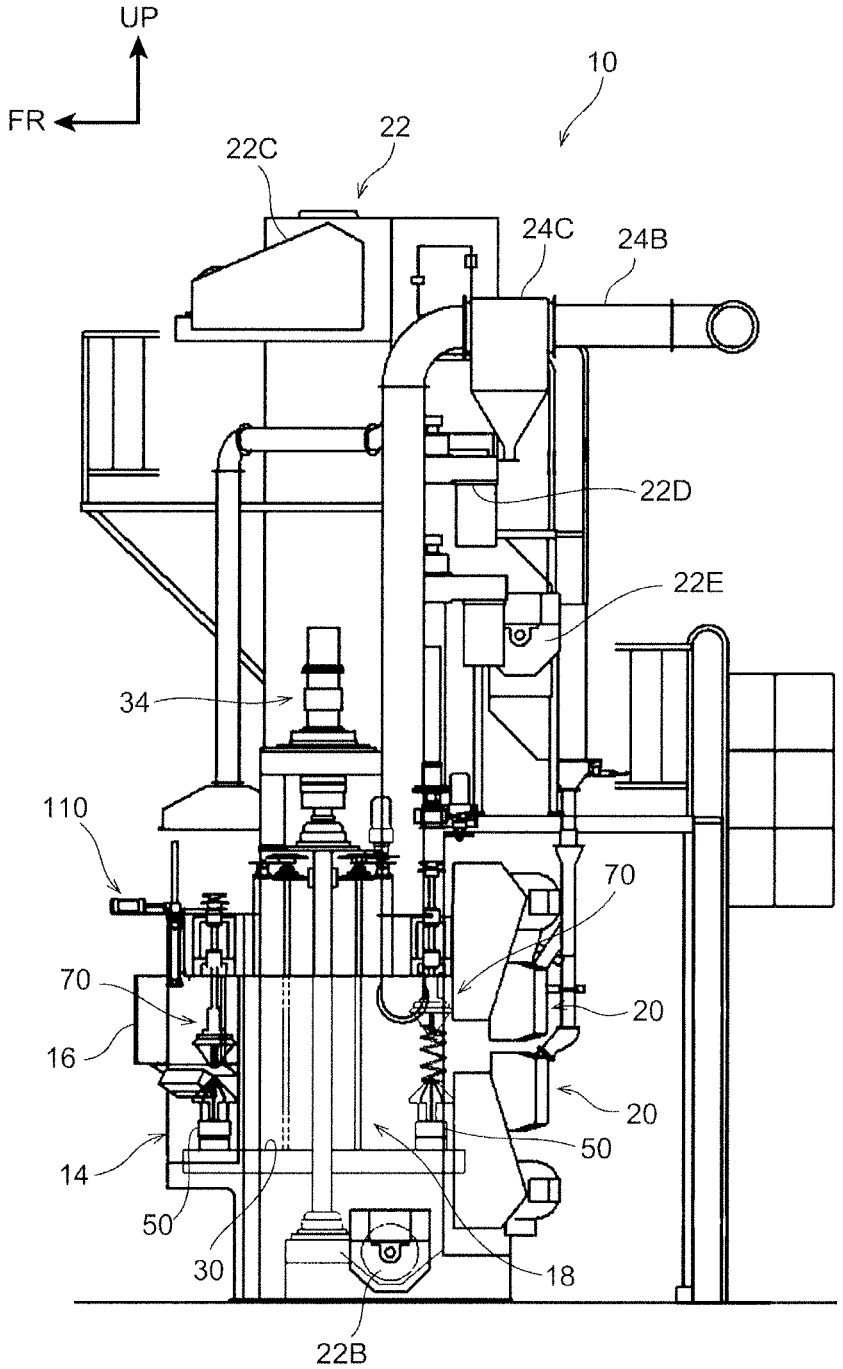
FIG. 2 is a right side view of the shot peening apparatus according to the first embodiment shown in a partially perspective view.
Figure 3:
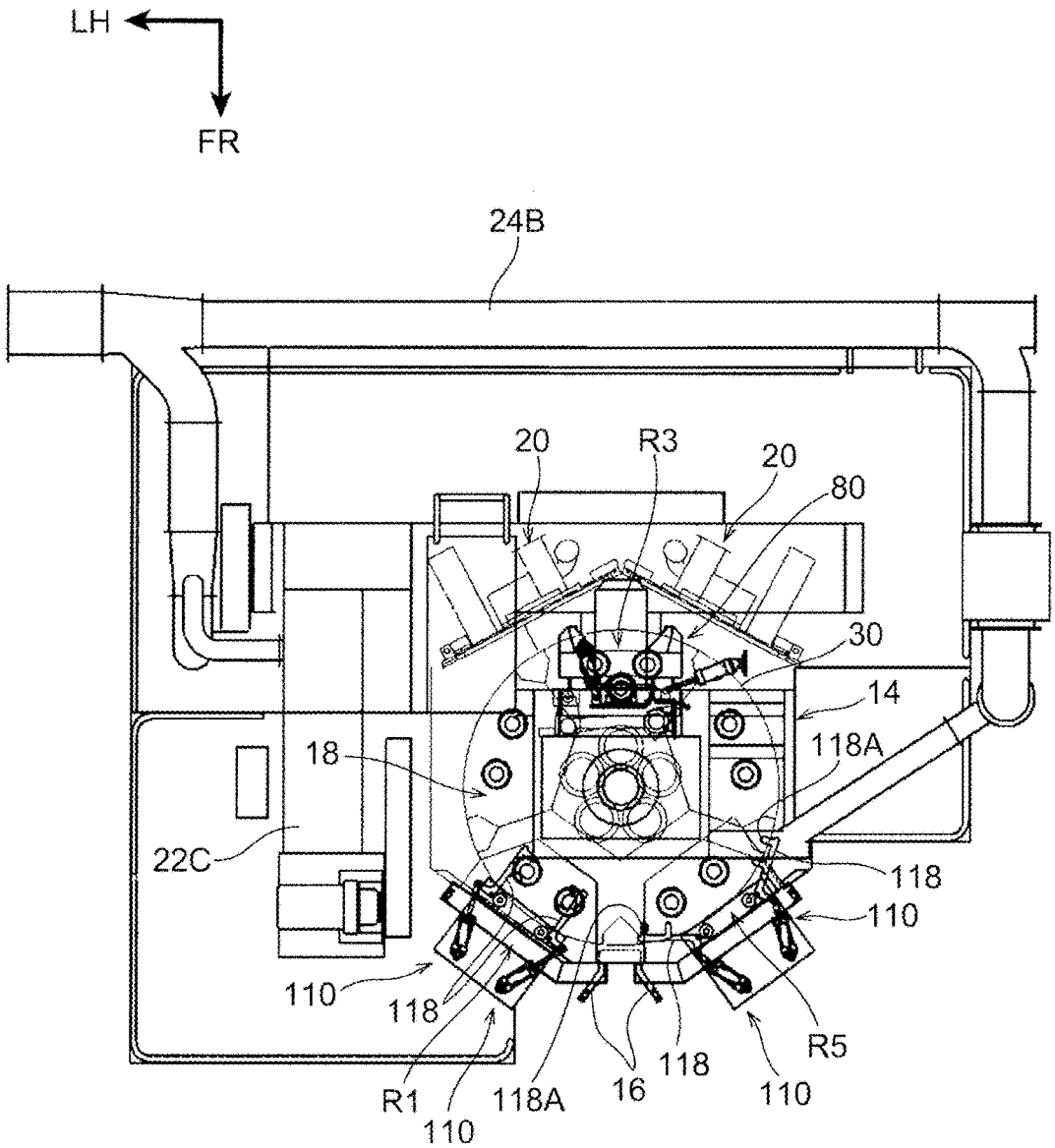
FIG. 3 is a plan view of the shot peening apparatus according to the first embodiment shown in a partially perspective view.

FIG. 1 is a front view of the shot peening apparatus 10. FIG. 2 is a right side view of the shot peening apparatus 10. FIG. 3 is a plan view of the shot peening apparatus 10. The shot peening apparatus 10 is a stress peening machine that performs peening with a stress kept exerted on a workpiece. A workpiece 12 subjected to a shot peening process is an object that needs to be held by applying a predetermined stress during a shot peening process, and specific examples include products such as compression coil springs (in a broad sense, elements known as "spring members").

As shown in FIG. 1, the shot peening apparatus 10 includes a cabinet 14. In the inside of the cabinet 14, a projection chamber R3 (see FIG. 4) is formed. Shot is projected to a workpiece 12 in the projection chamber R3 to surface-treat the workpiece 12. The cabinet 14 has a loading port 14A for loading a workpiece 12 into the cabinet and an unloading port 14B for unloading a workpiece 12 from the cabinet. The loading port 14A and the unloading port 14B are each provided with an area sensor 16 (see FIG. 3).

At the bottom of the cabinet 14, a product mount 18 is provided, on which a workpiece 12 is placed. The product mount 18 will be described later. As shown in FIG. 2, at a side portion of the cabinet 14, a plurality of (in the present embodiment, two at the top and two at the bottom, in total, four) centrifugal projectors 20 are provided. The impellers of the projectors 20 rotate to apply centrifugal force to the shot (in the present embodiment, steel balls by way of example).

Figure 4:
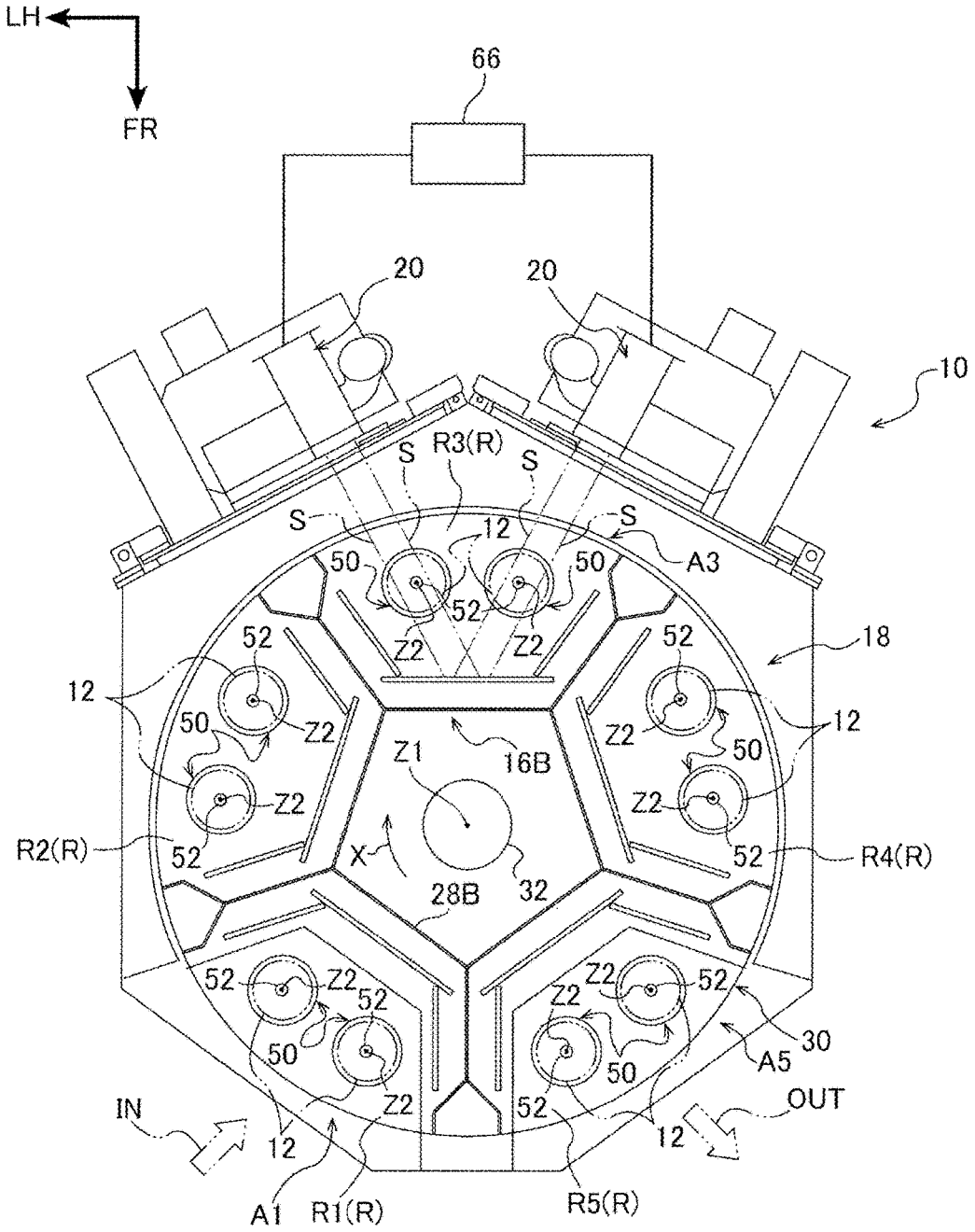
FIG. 4 is a schematic configuration diagram illustrating a configuration of the product mount and an arrangement position of the projectors in FIG. 3 as viewed from above.

FIG. 4 is a schematic configuration diagram illustrating a configuration of the product mount 18 and an arrangement location of the projectors 20 shown in a plan view in cross section. The projectors 20 illustrated in this figure accelerate shot by centrifugal force to project the shot to the workpiece 12 in the projection chamber R3. The projectors 20 are connected to a controller 66 so that the timing of projection by the projectors 20 is controlled by the controller 66.

As shown in FIG. 1, the shot peening apparatus 10 includes a circulator 22 to convey the shot projected by the projectors 20 to be circulated to the projectors 20. The circulator 22 includes a hopper 22A for recovering the shot. The hopper 22A is disposed below the product mount 18. Below the hopper 22A, a screw conveyor 22B is provided. The screw conveyor 22B is disposed such that its longitudinal direction extends in the right-left direction and is driven by a drive motor 22M1. The drive motor 22M1 is driven so that the screw conveyor 22B conveys the shot dropped down from the hopper 22A to the left side.

At the downstream side of the screw conveyor 22B in the conveyance direction, the lower end side of a conventionally known bucket elevator 22C extending in the top-bottom direction is disposed. The bucket elevator 22C scoops the shot recovered (temporarily stored) by the screw conveyor 22B with a bucket (not shown) and conveys the shot in the bucket to above the cabinet 14.

In the vicinity of the upper side of the bucket elevator 22C, a separator 22D is disposed. The separator 22D has the function of separating the shot conveyed by the bucket elevator 22C into shot having usable particle diameters and shot having unusable particle diameters. The separator 22D is in communication with the upstream side of a screw conveyor 22E to feed only the shot having usable particle diameters to the upstream side of the screw conveyor 22E. The screw conveyor 22E is disposed such that its longitudinal direction extends in the right-left direction and is driven by a drive motor 22M3. The screw conveyor 22E conveys the shot fed from the separator 22D to the right side to supply the shot to the projectors 20.

On a side wall of the cabinet 14, a ventilator 24A (ventilation opening) is disposed. To the cabinet 14, a duct 24B is connected so that dust produced in the cabinet 14 is sucked from the cabinet 14 into the duct 24B together with the air sucked from the ventilator 24A. In the middle of the route of the duct 24B, a settling chamber 24C is attached. The settling chamber 24C produces a classifying flow in the air including the sucked dust to separate particles in the sucked air. A dust collector (not shown) is also connected to the duct 24B. The dust collector filters out the dust in the air passed through the settling chamber 24C and the duct 24B to selectively discharge the purified air (clean air) to the outside of the apparatus.

The product mount 18 illustrated, for example, in FIG. 4 will now be described specifically. As shown in FIG. 4, a rotary table 30 serving as a "rotating table" is disposed in the product mount 18. The rotary table 30 is able to rotate (revolve) about the axis (center axis) Z1 of a rotary shaft 32 extending in the top-bottom direction. The rotary table 30 is disposed at a position including a projection range in which shot is projected by the projectors 20 (both sides of the projection range are shown by dashed and double-dotted lines S) and a non-projection range other than the projection range. The space above the rotary table 30 includes a projection area A3 (projection station) in which the projectors 20 perform projection on a workpiece 12, a loading area A1 (loading station) adjacent to the loading port 14A (see FIG. 1), and an unloading area A5 (unloading station) adjacent to the unloading port 14B (see FIG. 1). In the figure, the direction of rotation of the rotary table 30 (in other words, the direction of conveyance of a workpiece 12) is denoted by the arrow X, the direction of loading of a workpiece 12 is denoted by the arrow IN, and the direction of unloading of a workpiece 12 is denoted by the arrow OUT.

Above the rotary table 30, a disk-shaped top member 28A (see FIG. 5) is provided. The top member 28A is set to have the same diameter as the rotary table 30 and is disposed concentrically with the rotary shaft 32. The top member 28A is coupled with the rotary table 30 in the top-bottom direction through a column member 28B. The top member 28A is thus rotatable integrally with the rotary table 30. The column member 28B is disposed radially outside of the rotary shaft 32 to divide the arrangement area for set tables 50 described later from the area on the rotary shaft 32 side and to partition the arrangement area for set tables 50 into equal parts in the peripheral direction. A plurality of (in the present embodiment, five) process chambers R are thus formed in the space above the rotary table 30.

The process chambers R will now be described. The process chambers R are disposed in the interior space of the cabinet 14 and each may serve as any of a loading chamber R1, a loading-side seal chamber R2, a projection chamber R3, an unloading-side seal chamber R4, and an unloading chamber R5 through rotational displacement of the rotary table 30. The loading chamber R1 is a room disposed in the previously mentioned loading area A1 for loading a workpiece 12. The projection chamber R3 is a room disposed in the previously mentioned projection area A3 for performing a peening process (surface treatment) on a workpiece 12 through projection of shot to the workpiece 12. The unloading chamber R5 is a room disposed in the previously mentioned unloading area A5 for unloading a workpiece 12.

The loading-side seal chamber R2 is disposed between the loading area A1 and the projection area A3 to prevent leakage of shot from the projection chamber R3 to the loading chamber R1. The unloading-side seal chamber R4 is disposed between the projection area A3 and the unloading area A5 to prevent leakage of shot from the projection chamber R3 to the unloading chamber R5. In the configuration described above, the rotary table 30 is rotatably displaced by a predetermined angle (in the present embodiment, 72°) around the rotary shaft 32, so that, for example, a process chamber R initially serving as the loading chamber R1 serves as the loading-side seal chamber R2, the projection chamber R3, the unloading-side seal chamber R4, and the unloading chamber R5. As described above, the region on the rotary table 30 is partitioned into five regions, that is, five process chambers R by the column member 28B in the peripheral direction. Among these regions, the projection chamber R3 is a projection region in which shot from the projectors 20 is projected. The regions excluding the projection chamber R3, that is, the loading chamber R1, the loading-side seal chamber R2, the unloading-side seal chamber R4, and the unloading chamber R5 are non-projection regions in which shot from the projectors 20 is not projected.

Rubber seals are provided on the cabinet 14 side to seal the gaps between the partition from the projection chamber R3 and the partition from the loading chamber R1 in the loading-side seal chamber R2 and the periphery thereof as well as the gaps between the partition from the projection chamber R3 and the partition from the unloading chamber R5 in the unloading-side seal chamber R4 and the periphery thereof. These rubber seals shut out the projected shot and prevent leakage (scattering) of the shot.

On the rotary table 30, a plurality of set tables 50 are provided for supporting (setting) workpieces 12 from below. The set tables 50 are disposed in the peripheral direction of the rotary table 30 such that two (a pair) of them are disposed in each process chamber R. That is, in the present embodiment, 10 set tables 50 are disposed in the peripheral direction of the rotary table 30. Each of the set tables 50 has an approximately cylindrical shape extending in the top-bottom direction (see FIG. 5). That is, the product mount 18 has a multi-table structure.

Figure 5:
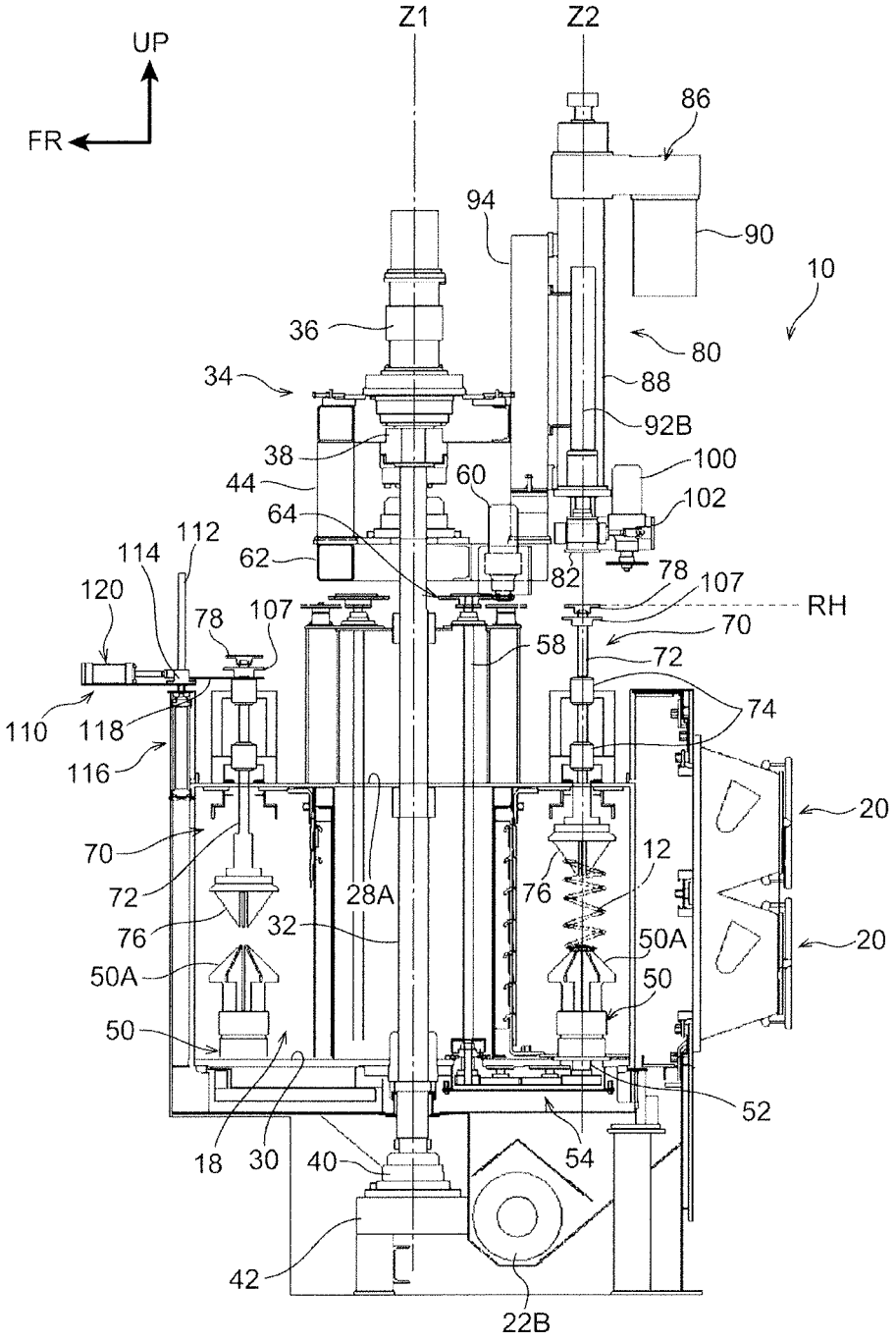
FIG. 5 is a cross-sectional view of the main part of the shot peening apparatus according to the first embodiment shown in a right side view.
Figure 6:
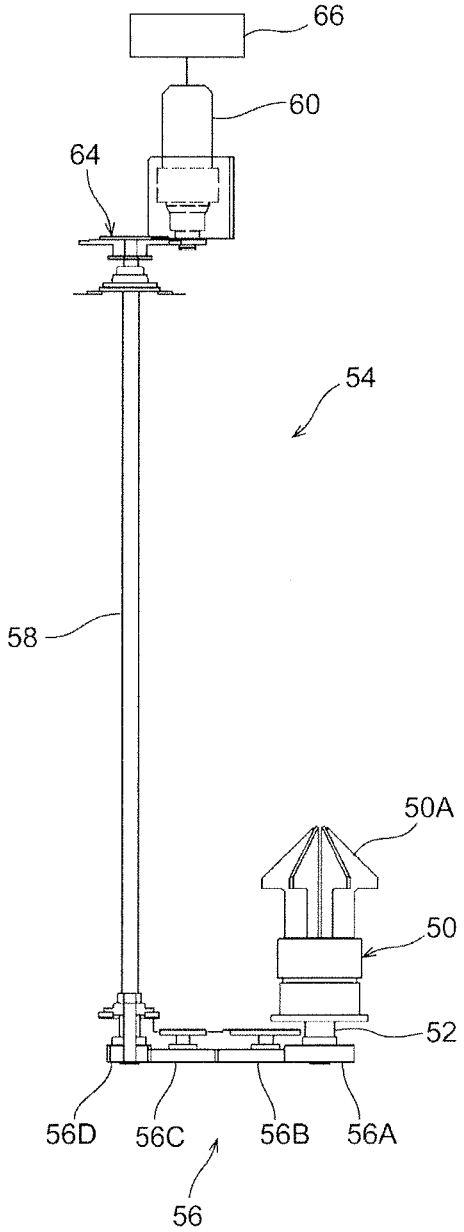
FIG. 6 is a side view of a set table driving mechanism for use in the shot peening apparatus according to the first embodiment.

As shown in FIG. 6, at the axial center of each set table 50, a rotary shaft 52 extending in the axis Z2 (see FIG. 5) is provided so as to be integrally rotate. The rotary shaft 52 protrudes downward from the set table 50. Each of the set tables 50 is configured to be able to individually rotate (rotate on its own axis) about the axis Z2 extending in the top-bottom direction. On the top of the set table 50, a set part 50A is formed approximately in a conical shape having its vertex on the upper side. When a workpiece 12 (coil spring) is set on the set part 50A, the set part 50A comes into the lower end of the workpiece 12 (coil spring). In this manner, the set table 50 supports a workpiece 12 from below such that the workpiece 12 is rotatable about the axis Z2. In FIG. 5, the axis Z2 of the set table 50 disposed in the projection chamber R3 alone is illustrated, for convenience of explanation.

The workpieces 12 on a pair of set tables 50 disposed in the projection chamber R3 are subjected to projection (peening process) of shot from the projectors 20, one at the top and one at the bottom, and are simultaneously processed. Not only the direct projection from the projectors 20 but also the shot reflected on the inner wall of the projection chamber R3 impinges on the workpieces 12 in the projection chamber R3 to enable an efficient peening process.

As shown in FIG. 5, the shot peening apparatus 10 includes a rotating table driving mechanism 34 for driving rotation (revolution) of the rotary table 30 and a set table driving mechanism 54 for driving rotation (rotation on its own axis) of the set table 50.

The rotating table driving mechanism 34 includes an indexing device 36. The indexing device 36 is connected to the upper end of the rotary shaft 32 of the rotary table 30 through a torque limiter 38. The lower end of the rotary shaft 32 of the rotary table 30 is disposed on a base 42 with a bearing part 40 interposed. The torque limiter 38 is attached to the upper end of the rotary shaft 32. The indexing device 36 is a known indexing device and details thereof are not illustrated. The indexing device 36 includes a servomotor for intermittently advancing the rotary table 30. In this configuration, the indexing device 36 has the rotary table 30 mounted on the base 42 so as to enable rotary indexing at a predetermined rotary angle position and enable clamping (holding) at the indexing position and rotates the rotary table 30 around the rotary shaft 32 at rotation angle (in the present embodiment 72°) pitches according to the number of process chambers R (in the present embodiment, five chambers) on the rotary table 30. In other words, the indexing device 36 rotates (intermittently advances) the rotary table 30 at rotation angle pitches set according to the arrangement of the set tables 50 around the rotary shaft 32 of the rotary table 30. In a state in which the indexing device 36 suspends the rotary table 30, any of the set tables 50 (in the present embodiment, any two of them) are set so as to be disposed in the projection range in the rotary table 30 (see FIG. 4).

The indexing device 36 is connected to the controller 66 (not shown in FIG. 5). The controller 66 performs control such that the rotary table 30 is intermittently operated (rotated) by the indexing device 36 after projection by the projectors 20 is suspended (interrupted), and performs control such that projection by the projectors 20 is performed during suspension of the rotary table 30. This configuration prevents or minimizes leakage (scattering) of shot from the projection chamber R3 to the outside of the chamber. Projection by the projectors 20 may be performed during rotation of the rotary table 30. In this case, the controller 66 may perform control such that projection by the projectors 20 is interrupted during rotation of the rotary table 30 in order to prevent leakage of shot.

As shown in FIG. 6, the set table driving mechanism 54 includes a gear train 56. The gear train 56 has a gear 56A to a gear 56D. The gear 56A is secured concentrically to the lower end of the rotary shaft 52 of the set table 50 and connected to the gear 56D disposed on the central side of the rotary table 30 with the gears 56B and 56C interposed. To the axial center of the gear 56D, a driving force-transmitting shaft 58 is secured. The driving force-transmitting shaft 58 extends from the gear 56D upward to pass through the rotary table 30 and the top member 28A (see FIG. 5). The lower end of the driving force-transmitting shaft 58 is supported on the gear 56D with a bearing interposed. The upper end of the driving force-transmitting shaft 58 is supported on a driving force-transmission 64 with a bearing interposed.

The set table driving mechanism 54 also has a drive motor 60. The drive motor 60 is fixed to the apparatus frame 62 side (see FIG. 5). With the rotation of the rotary table 30, the drive motor 60 is coupled to the driving force-transmission 64 provided to the upper end of the driving force-transmitting shaft 58. Specifically, when the rotation of the rotary table 30 allows the set table 50 to reach the projection position, the driving force-transmission 64 couples the drive motor 60 with the driving force-transmitting shaft 58. In this configuration, the drive motor 60 is driven so that the driving force of the drive motor 60 is transmitted to the rotary shaft 52 of the set table 50 to allow the set table 50 to rotate (rotate on its own axis) about the rotary shaft 52. The drive motor 60 is connected to the controller 66 so that, for example, the timing for starting rotation of the set table 50 is controlled by the controller 66.

A retaining mechanism 70, a lifting mechanism 80, a drive motor 100 serving as "rotational force driver", and a transmission mechanism 106, which are main parts in an embodiment of the present invention, will now be described.

As shown in FIG. 5 and FIG. 7, the retaining mechanism 70 is a mechanism for retaining a workpiece 12 set on the set table 50 from above. In the projection chamber R3, the pressing force (compressive force) applied by the lifting mechanism 80 and the rotational force applied by the drive motor 100, which will be described later, are transmitted by the retaining mechanism 70 to the workpiece 12.

First, the retaining mechanism 70 will be described. The retaining mechanism 70 is disposed above the set tables 50 and provided corresponding to a pair of set tables 50. That is, in the present embodiment, five retaining mechanisms 70 are employed. Each retaining mechanism 70 includes transmission shafts 72 serving as a pair of "retainers" such that their axial direction extends in the top-bottom direction. Each transmission shaft 72 is disposed above the set table 50 concentrically with the set table 50, that is, along the axis Z2. Each transmission shaft 72 is disposed to be opposed to the set table 50 with a workpiece 12 interposed. A pair of transmission shafts 72 are movably supported by respective lift rotation holding parts 74 in the direction of the axis Z2 and supported rotatably about the axis Z2. The lift rotation holding parts 74 are coupled to the top member 28A so as to be unable to relatively move.

At the lower end of each transmission shaft 72, an abutment part 76 is provided to come into abutment with the workpiece 12 on the set table 50 from above. The transmission shaft 72 moves in the top-bottom direction so that the abutment part 76 is lifted and lowered (moved) between a distant position where the abutment part 76 is disposed at a distance above the workpiece 12 on the set table 50 and a retaining position where the abutment part 76 retains the workpiece 12 on the set table 50 from above. The abutment part 76 is formed approximately in a conical shape having its vertex on the lower side and comes into the upper end of the workpiece 12 (coil spring).

At the upper end of each transmission shaft 72, a load receiving member 78 is provided. The load receiving member 78 is formed in the shape of a plate having its thickness direction in the top-bottom direction. At the axial center of the load receiving member 78, a bearing is formed in communication with the lower side. The upper end of the transmission shaft 72 is inserted into the bearing so that the load receiving member 78 is rotatably supported on the transmission shaft 72. To the upper end of each transmission shaft 72, a sprocket 107, which constitutes the transmission mechanism 106 described later, is concentrically secured at a position lower than the load receiving member 78. The lower surface of the sprocket 107 is an engagement part 107A. The engagement part 107A can be engaged with an arm 118 of the mounting and demounting mechanism 110 described later. A pair of the sprockets 107 are coupled with each other by a chain 109 described later.

The lifting mechanism 80 will now be described. As shown in FIG. 5 and FIG. 8, the lifting mechanism 80 is to apply pressing force to the transmission shaft 72 of the retaining mechanism 70 conveyed to the projection chamber R3. In an embodiment, the lifting mechanism 80 is provided exclusively above the projection chamber R3 in the projection region. The lifting mechanism 80 has a pressing holder 82 serving as a "pressing unit", which constitutes a lower part of the lifting mechanism 80. The pressing holder 82 is formed approximately in the shape of a rectangular parallelepiped having its longitudinal direction in the right-left direction and is disposed to be opposed to a pair of load receiving members 78 of the retaining mechanism 70 in the top-bottom direction. The pressing holder 82 can be lifted and lowered between a retracted position at a distance above the load receiving members 78 and a coupling position in abutment with the load receiving members 78 from above to be coupled with the load receiving members 78.

A lifting rod 84 is fixed to the pressing holder 82 at the center in the longitudinal direction. The lifting rod 84 extends from the pressing holder 82 to the upper side. The top portion of the lifting rod 84 is disposed in a cylinder 88 of a servo cylinder 86 to be coupled with a not-shown ball screw. The ball screw rotates to move the lifting rod 84 in the top-bottom direction relative to the cylinder 88. That is, in the lifting mechanism 80, the lifting rod 84 is allowed to move relative to the cylinder 88 in the top-bottom direction, so that the pressing holder 82 is lifted and lowered between the retracted position and the coupling position.

The servo cylinder 86 includes an electric servo motor 90. The electric servo motor 90 is for driving the rotation of the ball screw. The motor shaft of the electric servo motor 90 is connected to the ball screw through a gear train (not shown). The electric servo motor 90 is also connected to the controller 66 so that the driving of the electric servo motor 90 is controlled based on, for example, a command from the controller 66 and a position detection result.

As described above, the pressing holder 82 of the lifting mechanism 80 is driven by the electric servo motor 90 to be lifted and lowered along the axis Z2 above the retaining mechanism 70. As shown in FIG. 5, the height position of the load receiving member 78 when the pressing holder 82 is not in contact with the load receiving members 78, that is, the height position of the pressing holder 82 when the pressing holder 82 is lowered from the top position to come into contact with the load receiving members 78 is defined as reference height RH. When the pressing holder 82 is located above the reference height RH, the pressing holder 82 of the lifting mechanism 80 is at a distance from a pair of the load receiving members 78 of the retaining mechanism 70. When the pressing holder 82 is located below the reference height RH, the lifting mechanism 80 abuts on (is coupled to) a pair of load receiving members 78 of the retaining mechanism 70 to apply downward pressing force to a pair of transmission shafts 72 of the retaining mechanism 70. Thus, a pair of transmission shafts 72 move downward in the direction of the axis Z2 to apply pressing force (compressive force) to a pair of workpieces 12 through a pair of abutment parts 76. As a result, a pair of workpieces 12 are compressed between a pair of abutment parts 76 and a pair of set parts 50A to cause stress in the pair of workpieces 12.

In the present embodiment, the controller 66 actuates the servo cylinder 86 at a timing when the set table 50 having the workpiece 12 set thereon reaches the projection position, and the workpiece 12 is fixed while the servo cylinder 86 accurately applies an adequate stress to the workpiece 12. Since the load receiving member 78 is rotatably supported on the transmission shaft 72, the rotation of the transmission shaft 72 around its own axis is permitted even when the pressing holder 82 presses the load receiving member 78.

At both sides in the longitudinal direction of the pressing holder 82, guide rods 92A are fixed. The guide rods 92A extend from the pressing holder 82 to the upper side. Each guide rod 92A is inserted through a tubular rod holder 92B having its axial direction in the top-bottom direction and is supported by the rod holder 92B so as to be able to relatively move in the top-bottom direction. The rod holder 92B is fixed to the apparatus frame 94. With this configuration, when the pressing holder 82 moves in the top-bottom direction (that is, the direction of the axis Z2), the guide rod 92A is displaced in the top-bottom direction while being guided by the rod holder 92B. The pressing holder 82 and the abutment part 76 therefore can move in the top-bottom direction stably without shaking in the right-left direction.

The drive motor (rotary drive unit) 100 is provided to the lifting mechanism 80 as shown in FIG. 9, (A) and (B) in FIG. 10. The drive motor 100 is a driving source for applying rotational force to the transmission shafts 72 of the retaining mechanism 70. The drive motor 100 is disposed such that its axial direction extends in the top-bottom direction and is coupled to the pressing holder 82 with a bracket 102 interposed. The output shaft 100A of the drive motor 100 protrudes downward. One end of the bracket 102 is rotatably attached to the pressing holder 82 such that its axial direction extends in the top-bottom direction. To the other end of the bracket 102, a piston cylinder 104 provided on the pressing holder 82 is coupled. When the piston cylinder 104 is actuated, the piston 104A of the piston cylinder 104 is extended from the cylinder 104B, so that the bracket 102 (drive motor 100) moves rotating about one end of the bracket 102. The drive motor 100 and the piston cylinder 104 are connected to the controller 66 so that the actuation timing of the drive motor 100 and the piston cylinder 104 is controlled by the controller 66.

The transmission mechanism 106 is provided between the drive motor 100 and the transmission shafts 72 of the previously mentioned retaining mechanism 70 as shown in (A) and (B) in FIG. 10 so that the transmission mechanism 106 transmits the rotational force of the drive motor 100 to the transmission shafts 72. The transmission mechanism 106 is constituted with the previously mentioned sprockets 107, a sprocket 108, and the chain 109. The sprocket 108 is secured concentrically with the output shaft 100A of the drive motor 100. The chain 109 is formed into an endless loop and is looped around a pair of sprockets 107 of the retaining mechanism 70. When the pressing holder 82 is lowered to the coupling position, the piston cylinder 104 is actuated to allow the drive motor 100 to move rotating about one end of the bracket 102, and the sprocket 108 is then coupled to the chain 109. The driving force (rotational force) of the drive motor 100 is thus transmitted by the transmission mechanism 106 to the transmission shaft 72, so that the transmission shaft 72 rotates on its own axis. In the present embodiment, the set table 50 is set to rotate prior to the transmission shaft 72. That is, in the shot peening apparatus 10 according to an embodiment, the driving force of the drive motor is transmitted to the transmission shaft 72 through the transmission mechanism 106 only when the pressing holder 82 of the lifting mechanism 80 abuts on the transmission shaft 72 of the retaining mechanism 70.

As shown in FIG. 3, FIG. 5, and FIG. 11, the shot peening apparatus 10 further includes a mounting and demounting mechanism 110. The mounting and demounting mechanism 110 is provided for each of the loading chamber R1 and the unloading chamber R5 and has the function of supporting mounting and demounting of a workpiece 12 on/from the set table 50. The mounting and demounting mechanism 110 will be described below. The mounting and demounting mechanism 110 has a pair of guide pins 112. Each guide pin 112 extends in the top-bottom direction to be directly or indirectly fixed to the cabinet 14. A lifting unit 114 is supported on the guide pin 112. The lifting unit 114 can be lifted and lowered in the longitudinal direction of the guide pin 112. To the lifting unit 114, a piston cylinder 116 is coupled for lifting and lowering the lifting unit 114. The piston cylinder 116 is connected to the controller 66. With this configuration, the piston cylinder 116 is actuated under the control of the controller 66 so that the piston 116A of the piston cylinder 116 is extended and retracted relative to the cylinder 116B to allow the lifting unit 114 to be lifted and lowered in the longitudinal direction of the guide pin 112.

An arm 118 is attached to the lifting unit 114. The arm 118 extends horizontally from the lifting unit 114. A portion at the base end side of the arm 118 is coupled to the lifting unit 114 such that the arm 118 can rotate around the guide pin 112. The arm 118 thus can rotate between a ready position illustrated in the unloading chamber R5 in FIG. 3 and an engagement position illustrated in the loading chamber R1 in FIG. 3.

As shown in FIG. 3, the front end of the arm 118 has a hook 118A opened to shaft 72 (retaining mechanism 70) side in a plan view. The arm 118 is rotated to the engagement position so that the hook 118A is engaged with the engagement part 107A of the sprocket 107 in the transmission shaft 72. In a state in which the arm 118 is disposed in the standby position, the engagement of the arm 118 with the transmission shaft 72 is released to avoid interference of the hook 118A with the retaining mechanism 70 when the rotary table 30 is rotated (revolved).

As shown in FIG. 11, at the base end of the arm 118, a piston cylinder 120 is coupled for rotating the arm 118. The piston cylinder 120 is connected to the controller 66. The controller 66 actuates the piston cylinder 120 so that the piston 120A of the piston cylinder 120 is extended/retracted from/into the cylinder 120B to allow the arm 118 to rotate between the standby position and the engagement position. With this configuration, the arm 118 is lifted with the hook 118A being engaged with the engagement part 107A of the retaining mechanism 70, so that the retaining mechanism 70 is disposed in the distant position to facilitate mounting and demounting of the workpiece 12 on/from the set table 50. When a workpiece 12 is mounted on the set table 50, the arm 118 is rotated to the standby position, so that the engagement of the arm 118 with the retaining mechanism 70 is released to allow the retaining mechanism 70 to be lowered due to its own weight.

The operation and effects of the foregoing embodiment will now be described with a description of a shot processing method using the shot peening apparatus 10 configured as described above.

First, a workpiece 12 is set on a set table 50 in the loading chamber R1 disposed in the loading area A1. In this state, the retaining mechanism 70 is disposed in the distant position by the mounting and demounting mechanism 110, with the arm 118 of the mounting and demounting mechanism 110 being engaged with the transmission shaft 72 (the sprocket 107 therein) of the retaining mechanism 70. The workpiece 12 is set on the set table 50, and the mounting and demounting mechanism 110 is actuated to release the engagement of the arm 118 with the retaining mechanism 70. The workpiece 12 is thus held between the retaining mechanism 70 and the set table 50 due to the weight of the retaining mechanism 70.

Next, the rotating table driving mechanism 34 drives the rotary table 30 to rotate around the rotary shaft 32 by a predetermined angle and suspends the rotary table 30 at a predetermined position. When the set table 50 reaches the projection range (in other words, the projection area A3) where shot is projected, the lifting mechanism 80 is actuated to lower the pressing holder 82 of the lifting mechanism 80. When the pressing holder 82 is lowered to the coupling position, the pressing holder 82 presses the load receiving member 78 downward to apply pressing force to the transmission shaft 72. At this moment, the workpiece 12 is retained by the abutment part 76 with an adequate pressing force, because the lifting mechanism 80 is configured to include the servo cylinder 86.

The piston cylinder 104 of the transmission mechanism 106 is actuated so that the transmission mechanism 106 couples the drive motor 100 of the lifting mechanism 80 to the transmission shaft 72 of the retaining mechanism 70. The set table driving mechanism 54 is then actuated to rotate the set table 50 around the rotary shaft 52. In addition, the drive motor 100 of the lifting mechanism 80 is driven to rotate the transmission shaft 72 in the same direction as the rotation of the set table 50, after the rotation of the set table 50. The workpiece 12 is thus rotated.

Next, the projectors 20 project shot to the workpiece 12 held between the set table 50 and the abutment part 76 to receive rotational force, diagonally from the upper side and the lower side. This configuration prevents or minimizes poor rotation of the workpiece 12, and the workpiece 12 undergoes projection of shot while being stably rotated. As a result, a peening process is performed evenly, resulting in excellent peening.

Upon completion of the peening process on the workpiece 12, the projection by the projectors 20 is finished. The piston cylinder 104 of the transmission mechanism 106 is actuated to release the coupling between the drive motor 100 and the transmission shaft 72. The lifting mechanism 80 is then actuated to lift the pressing holder 82 of the lifting mechanism 80 to release the coupling between the pressing holder 82 and the load receiving member 78. The rotating table driving mechanism 34 is then actuated to drive the rotary table 30 to rotate around the rotary shaft 32 by a predetermined angle.

In the unloading chamber R5 disposed in the unloading area A5, the mounting and demounting mechanism 110 is actuated to engage the arm 118 of the mounting and demounting mechanism 110 with the engagement part 107A of the retaining mechanism 70 and to lift the retaining mechanism 70 to the distant position. The workpiece 12 is dismounted from the set table 50 in this state. It is needless to say that a series of operations of the components in the shot peening apparatus 10 is controlled by the controller 66.

In the shot peening apparatus 10, the lifting mechanism 80 is provided above the retaining mechanism 70, and the lifting mechanism 80 is configured to be able to be lifted and lowered between the coupling position where it is coupled to the retaining mechanism 70 and the retracted position where it is at a distance from the retaining mechanism 70, That is, the retaining mechanism 70 is separate from the lifting mechanism 80. The lifting mechanism 80 is coupled to the retaining mechanism 70 to apply downward pressing force to the retaining mechanism 70. The rotational force of the drive motor 100 provided to the lifting mechanism 80 is applied to the retaining mechanism 70 through the transmission mechanism 106. In a multi-table type (in which a plurality of set tables are disposed on a rotary table and the set tables are conveyed to the loading chamber, the projection chamber, and the unloading chamber) shot processing apparatus like the shot peening apparatus 10, the lifting mechanism 80 is provided for the set table 50 disposed in the projection chamber R3, so that the lifting mechanism 80 is not required for the set tables 50 disposed in the loading chamber R1 and the unloading chamber R5. In a single table-type (in which the projection chamber doubles as the loading chamber and the unloading chamber) shot processing apparatus, the lifting mechanism 80 is provided for the set table 50, so that shot can be projected to the workpiece 12 by the projectors while the workpiece 12 is rotated with pressing force being applied to the workpiece 12. As described above, a versatile structure can be implemented in the shot processing apparatus.

The retaining mechanism 70 has the transmission shaft 72, and the load receiving member 78 is rotatably supported on the upper end of the transmission shaft 72. In the coupling position, the load receiving member 78 is pressed downward by the pressing holder 82 of the lifting mechanism 80. This configuration enables rotation of the transmission shaft 72 while applying downward pressing force to the transmission shaft 72.

The transmission mechanism 106 constituted with the sprockets 107, the sprocket 108, and the chain 109 transmits the rotational force from the drive motor 100 to the retaining mechanism 70. The rotational force from the drive motor 100 thus can be transmitted to a plurality (a pair) of transmission shafts 72 of the retaining mechanism 70.

The set table 50 is set so as to rotate prior to the transmission shaft 72 of the retaining mechanism 70 when the set table 50, the transmission shaft 72 of the retaining mechanism 70, and the workpiece 12 rotate. The relative rotation between the workpiece 12 and the set table 50 is thus prevented or minimized. This configuration prevents or minimizes damage and the like at the contact portion of the workpiece 12 with the set table 50.

As described above, the shot peening apparatus 10 is configured as a multi-table type shot processing apparatus, and the lifting mechanism 80 is provided corresponding only to the set table 50 disposed in the projection range. In the multi-table type shot peening apparatus 10, the lifting mechanism 80 is thus configured efficiently, and cost increase of the shot peening apparatus 10 as a whole can be prevented or minimized.

In the loading chamber R1 and the unloading chamber R5, the mounting and demounting mechanism 110 is actuated in a state in which the mounting and demounting mechanism 110 is engaged with the retaining mechanism 70, so that the retaining mechanism 70 can be elevated to the distant position. This configuration facilitates mounting and demounting of the workpiece 12 on/from the set table 50.

(Second Embodiment)

Referring to FIG. 12 and FIG. 13, a shot peening apparatus 200 according to a second embodiment will be described below. The shot peening apparatus 200 according to the second embodiment is configured in the same manner as the first embodiment, except the followings.

As shown in FIG. 12, in the second embodiment, the lifting mechanisms 80 are provided corresponding to the set tables 50 disposed in the loading chamber R1 and the unloading chamber R5. In other words, the lifting mechanism 80 is not provided corresponding to the set table 50 disposed in the projection chamber R3. An engagement piece 202 is integrally provided to the pressing holder 82 of the lifting mechanism 80. The engagement piece 202 protrudes downward from the pressing holder 82 and is formed approximately in the shape of a reversed T in cross section. The engagement piece 202 constitutes the mounting and demounting mechanism 110. The cross-sectional shape of the engagement piece 202 may not be approximately the shape of a reversed T.

As shown in (A) and (B) in FIG. 13, the retaining mechanism 70 has a pair of guide rods 204 each having its axial direction in the top-bottom direction. The guide rods 204 are coupled to the top member 28A (see FIG. 12) so as to be unable to relatively move. The retaining mechanism 70 also has a lifting member 206 provided on the guide rods 204 so as to be able to be lifted and lowered. The respective upper ends of the transmission shafts 72 of the retaining mechanism 70 are rotatably supported on the lifting member 206, and the transmission shafts 72 and the lifting member 206 are unable to relatively move in the top-bottom direction. The load receiving member 78 of the retaining mechanism 70 is coupled to the lifting member 206 so as to be unable to relatively move and includes a pair of load receiving pieces 208 each approximately in the shape of an L. Specifically, the respective upper walls of the load receiving pieces 208 are bent to face each other such that a slit 210 (see (B) in FIG. 13) is formed between the load receiving pieces 208. When the retaining mechanism 70 rotates in the peripheral direction of the rotary table 30, the engagement piece 202 of the lifting mechanism 80 passes through the inside of the slit 210, so that the engagement piece 202 can be engaged with the load receiving pieces 208 in the top-bottom direction (see FIG. 12). With this configuration, the lifting mechanism 80 is lifted so that the retaining mechanism 70 is disposed in the distant position. The lifting mechanism 80 is lowered so that the pressing holder 82 of the lifting mechanism 80 presses the load receiving member 78 (the load receiving pieces 208) of the retaining mechanism 70 downward to apply pressing force to the workpiece 12 through the transmission shafts 72.

As shown in FIG. 12, the drive motor 100 is disposed above the projection chamber R3 and fixed to the apparatus frame 44. The output shaft 100A (not shown in FIG. 12) of the drive motor 100 protrudes downward.

The transmission mechanism 106 is configured to include a motor-side gear 212 secured to the output shaft 100A of the drive motor 100, a pair of shaft-side gears 214 fixed to the transmission shafts 72 of the retaining mechanism 70, and a first coupling gear 216 and a second coupling gear 218 for coupling the motor-side gear 212 (not shown in FIG. 13) with the shaft-side gears 214, as shown in (A) and (B) in FIG. 13. The first coupling gear 216 is secured to a support shaft 220 rotatably provided on the lifting member 206 and is meshed with a pair of shaft-side gears 214. The second coupling gear 218 is secured to the upper portion of the support shaft 220 such that the second coupling gear 218 is meshed with the motor-side gear 212 when the retaining mechanism 70 is disposed in the projection chamber R3.

The retaining mechanism 70 is provided with a lock mechanism 222. The lock mechanism 222 is configured as a cylinder with a pneumatic lock. That is, the lock mechanism 222 is configured to include a cylinder 224 and a rod 226 accommodated in the cylinder 224. The rod 226 protrudes downward from the cylinder 224. The front end of the rod 226 is coupled with the transmission shafts 72 of the retaining mechanism 70 with the lifting member 206 interposed. The lock mechanism 222 is electrically connected to the controller 66 (not shown in FIG. 12 and FIG. 13) so as to be actuated under the control of the controller 66. After the lifting mechanism 80 is lowered, the lock mechanism 222 is actuated to prevent the upward movement of the transmission shafts 72 and the lifting member 206.

A shot processing method using the shot peening apparatus 200 will now be described. First, a workpiece 12 is set on a set table 50 in the loading chamber R1 disposed in the loading area A1, in the same manner as in the first embodiment. At this moment, the engagement piece 202 of the lifting mechanism 80 passes through the inside of the slit 210 in the load receiving member 78 (the load receiving pieces 208) of the retaining mechanism 70, so that the engagement piece 202 is engaged with the load receiving pieces 208 in the top-bottom direction, and the retaining mechanism 70 is disposed in the distant position. The lifting mechanism 80 is then actuated to lower the pressing holder 82 of the lifting mechanism 80, and the pressing holder 82 then presses the load receiving member 78 downward to lower the transmission shaft 72. The pressing force (compressive force) is thus applied to the workpiece 12 so that the workpiece 12 is held between the retaining mechanism 70 and the set table 50.

Next, the lock mechanism 222 is actuated to lock the rod 226 of the lock mechanism 222. The upward movement of the lifting member 206 and the transmission shaft 72 is thus prevented to maintain the pressing on the workpiece 12 by the transmission shaft 72.

Next, the rotating table driving mechanism 34 allows the rotary table 30 to rotate around the rotary shaft 32. When the set table 50 reaches the projection range (in other words, the projection area A3), the motor-side gear 212 of the drive motor 100 is meshed with the second coupling gear 218 to enable transmission of the rotational force of the drive motor 100 to the transmission shaft 72. Subsequently, a peening process on the workpiece 12 is performed in the same manner as in the first embodiment.

After completion of the peening process on the workpiece 12, the rotating table driving mechanism 34 is actuated to drive the rotary table 30 to rotate around the rotary shaft 32 by a predetermined angle. At this moment, in the unloading chamber R5, when the rotation of the rotary table 30 allows the retaining mechanism 70 to rotate in the peripheral direction of the rotary table 30, the engagement piece 202 of the lifting mechanism 80 passes through the inside of the slit 210 of the load receiving pieces 208 of the retaining mechanism 70 to enable engagement of the engagement piece 202 with the load receiving pieces 208 in the top-bottom direction. The air in the lock part of the lock mechanism 222 is removed to release the lock state of the transmission shaft 72 and the lifting member 206. In this state, the lifting mechanism 80 is lifted to move the transmission shaft 72 upward together with the lifting mechanism 80. The transmission shaft 72 thus goes away from the workpiece 12 upward.

Also in the shot peening apparatus 200 in the second embodiment, the retaining mechanism 70 is separate from the lifting mechanism 80. In the state in which the transmission shaft 72 presses the workpiece 12, the upward movement of the transmission shaft 72 is prevented by the lock mechanism 222. In a multi-table type shot processing apparatus like the shot peening apparatus 200, the lifting mechanisms 80 are provided for the set tables 50 disposed in the loading chamber R1 and the unloading chamber R5, so that the lifting mechanism 80 is not required for the set table 50 located in the projection chamber R3. In the shot peening apparatus 200, the lifting mechanism 80 thus can be configured efficiently, and cost increase of the shot peening apparatus 200 as a whole can be prevented or minimized. In a single table-type shot processing apparatus, the lifting mechanism 80 is provided for the set table 50, so that shot can be projected to the workpiece 12 by the projector while the workpiece 12 is rotated with pressing force applied to the workpiece 12. As described above, also in the second embodiment, a versatile structure can be implemented in the shot processing apparatus.

In the first embodiment and the second embodiment, the shot peening apparatuses 10 and 200 are configured as multi-table type shot processing apparatuses. Alternatively, the shot peening apparatuses 10 and 200 may be configured without the rotary table 30 and such that the process chamber R includes the projection chamber R3 alone. That is, the shot peening apparatus 10 may be configured as a single table-type shot processing apparatus in which the loading chamber R1, the projection chamber R3, and the unloading chamber R5 are convertible. In the shot peening apparatus 200 in this case, the lock mechanism 222 may be eliminated. In the shot peening apparatuses 10 and 200 in this case, the mounting and demounting mechanism 110 may be provided in the projection chamber R3.

Although the transmission mechanism 106 includes the sprockets 107, the sprocket 108, and the chain 109 in the first embodiment, the transmission mechanism 106 may include a plurality of gears. For example, as shown in FIG. 14, the transmission mechanism 106 may include spur gears 121 secured to a pair of transmission shafts 72 and a spur gear 122 secured to the output shaft 100A of the drive motor 100. Also in this case, the driving force (rotational force) of the drive motor 100 can be transmitted to a plurality (a pair) of transmission shafts 72.

Although the transmission mechanism 106 includes the motor-side gear 212, the shaft-side gear 214, the first coupling gear 216, and the second coupling gear 218 in the second embodiment, the transmission mechanism 106 may include sprockets and a chain in the same manner as in the first embodiment.

Although the projector is the centrifugal projector 20 in the first embodiment and the second embodiment, the projector may be any other projector, for example, such as an air nozzle-type projector that feeds shot under pressure together with compressed air and impels the shot from a nozzle. Alternatively, a combination of the centrifugal projector 20 with the air nozzle-type projector may be used.

Although the shot processing apparatus is the shot peening apparatus 10 in the first embodiment and the second embodiment, the shot processing apparatus may be any other shot processing apparatus such as a shot blasting apparatus. Alternatively, an apparatus having the same configuration as the shot peening apparatus 10 may double as a shot peening apparatus and a shot blasting apparatus.

Although the indexing device 36 in the rotating table driving mechanism 34 allows the rotary table 30 to rotate around the rotary shaft 32 at predetermined rotation angle pitches in the first embodiment and the second embodiment, the rotating table driving mechanism may be, for example, a driving mechanism including any other structure including a position detection sensor for detecting the position of the set table so as to intermittently advance (rotate) the rotary table 30 by a rotation angle in accordance with the position of the set table.

In the first embodiment and the second embodiment, the set table driving mechanism 54 includes the gear train 56. Alternatively, the rotary shaft 52 may be coupled with the driving force-transmitting shaft 58, for example, through a belt.

Although the lifting mechanism 80 is configured to include the servo cylinder 86 in the first embodiment and the second embodiment, the lifting mechanism may be configured to include any other actuator.

In the first embodiment and the second embodiment, when the set table 50, the transmission shaft 72 of the retaining mechanism 70, and the workpiece 12 rotate, the set table 50 is set to be rotated prior to the transmission shaft 72 of the retaining mechanism 70. However, the set table 50 and the transmission shaft 72 may be set to rotate almost simultaneously.

In a modification to the first embodiment and the second embodiment, a rotation detecting sensor for detecting rotation of the abutment part 76 may be provided.

In a modification to the first embodiment and the second embodiment, in place of the configuration shown in FIG. 4, the area on the rotary table may be divided into two areas, namely, a loading/uploading area and a projection area, and the process chambers may be two rooms, namely, a projection chamber and a loading/unloading chamber. Alternatively, the area on the rotary table may be divided into a loading/unloading area, a projection area, and an intermediate area (provided between the loading/unloading area and the projection area), and the process chambers may serve as a projection chamber, a loading/unloading chamber, and a seal chamber (a room corresponding to the loading-side seal chamber and the unloading-side seal chamber in the foregoing embodiments).

More specifically, in a modification to the first embodiment and the second embodiment, the space above the rotary table may include a projection area in which the projectors perform projection to a workpiece and a loading/unloading area adjacent to the loading/unloading port for loading and unloading a workpiece. In the configuration of such a modification, a workpiece is loaded into the loading/unloading area through the loading/unloading port, reaches the projection area with the rotation of the rotary table, undergoes projection by the projectors in the projection area, then reaches the loading/unloading area with the rotation of the rotary table, and is unloaded from the loading/unloading area through the loading/unloading port.

In this modification, in part of the space above the rotary table, downstream from the projection area in the direction of rotation of the rotary table and upstream from the loading/unloading area in the direction of rotation of the rotary table, a blowing-off area may be provided for blowing off the shot on the workpiece. A jet port of a jet device may be disposed to be opposed to the blowing-off area so that the jet device can blow gas to the workpiece. In such a configuration, shot and the like left on the workpiece is blown off by blowing gas from the jet device.

In another modification, two or more projection chambers may be provided, or three or more set tables may be placed in a single process chamber.

According to a modification to the foregoing embodiments, one or both of the drive motors for the indexing device and the set table driving mechanism may be disposed below the rotary table.

In the second embodiment, the lock mechanism 222 is a cylinder with a pneumatic lock. However, the lock mechanism 222 may have any configuration that can prevent the upward movement of the transmission shaft 72 and the lifting member 206.

The foregoing embodiments and modifications above may be combined as appropriate in practice.

REFERENCE SIGNS LIST

10 . . . shot peening apparatus, 12 . . . workpiece, 30 . . . rotary table (rotating table), 50 . . . set table, 54 . . . set table driving mechanism, 70 . . . retaining mechanism, 72 . . . transmission shaft (retainer), 76 abutment part, 78 . . . load receiving member, 80 . . . lifting mechanism, 82 pressing holder (pressing unit), 100 . . . drive motor (rotational force driver), 106 . . . transmission mechanism, 110 . . . mounting and demounting mechanism, 200 . . . shot peening apparatus.

The invention claimed is:

1. A shot processing apparatus comprising:

a projector configured to project shot to a workpiece;

at least one set table configured to support the workpiece from below and be rotatable about an axis extending in a top-bottom direction;

at least one retaining mechanism including a retainer provided above the at least one set table and a load receiving member supported on an upper end of the retainer so as to be rotatable on the retainer, the retainer being configured to be rotatable about the axis and movable along a direction of the axis;

a rotational force driver configured to apply rotational force to the retainer through a transmission mechanism; and a lifting mechanism including a pressing holder capable of being lifted and lowered above the at least one retaining mechanism, the lifting mechanism being at a distance from the at least one retaining mechanism when the pressing holder is located above a reference height at which the pressing holder is in contact with the load receiving member, the lifting mechanism pressing the load receiving member to apply pressing force to the workpiece through the retainer when the pressing holder is located below the reference height.

2. The shot processing apparatus according to claim 1, wherein the rotational force driver is attached to the lifting mechanism.

3. The shot processing apparatus according to claim 2, wherein an abutment part is provided to a lower end of the retainer to come into abutment with the workpiece.

4. The shot processing apparatus according to claim 2, further comprising a rotating table configured to be rotatable about a center axis of the rotating table extending in the top-bottom direction, wherein a region above the rotating table is divided into a projection region in which the shot from the projector is projected and a non-projection region excluding the projection region, the at least one set table comprises a plurality of set tables, the at least one retaining mechanism comprises a plurality of retaining mechanism, on the rotating table, the plurality of set tables and the plurality of the retaining mechanisms are disposed in a peripheral direction of the rotating table, the rotating table rotates to allow the workpiece to be conveyed between the projection region and the non-projection region, and the lifting mechanism is provided exclusively above the projection region.

5. The shot processing apparatus according to claim 1, further comprising at least one lock mechanism configured to prevent upward movement of the retainer in a state in which the retainer applies pressing force to the workpiece.

6. The shot processing apparatus according to claim 5, further comprising a rotating table configured to be rotatable about a center axis of the rotating table extending in the top-bottom direction, wherein a region on the rotating table is divided into a projection region in which the shot from the projector is projected and a non-projection region excluding the projection region, the at least one set table comprises a plurality of set tables, the at least one retaining mechanism comprises a plurality of retaining mechanisms, the at least one lock mechanism comprises a plurality of lock mechanisms, on the rotating table, the plurality of set tables, the plurality of retaining mechanisms, and the plurality of lock mechanisms are disposed in a peripheral direction of the rotating table, the rotating table rotates to allow the workpiece to be conveyed between the projection region and the non-projection region, and the lifting mechanism is provided exclusively above the non-projection region.

7. The shot processing apparatus according to claim wherein the transmission mechanism includes a sprocket and a chain.

8. The shot processing apparatus according to claim 1, wherein the transmission mechanism includes a plurality of gears.

9. The shot processing apparatus according to claim 1, wherein the at least one set table is coupled with a set table driving mechanism actuated to rotate the at least one set table, and the set table driving mechanism is set to be actuated prior to the rotational force driver.

10. The shot processing apparatus according to claim 1, further comprising a mounting and demounting mechanism configured to support mounting and demounting of the workpiece on the at least one set table, wherein the mounting and demounting mechanism is configured to be engageable with the at least one retaining mechanism and to be lifted and lowered in the top-bottom direction.

* * * * *